US011800945B2

(12) United States Patent
Ben Amor

(10) Patent No.: US 11,800,945 B2
(45) Date of Patent: Oct. 31, 2023

(54) APPARATUS AND KIT FOR FLOOR PROTECTION

(71) Applicant: Saber Ben Amor, Montevarchi (IT)

(72) Inventor: Saber Ben Amor, Montevarchi (IT)

( * ) Notice: Subject to any disclaimer, the term of this patent is extended or adjusted under 35 U.S.C. 154(b) by 0 days.

(21) Appl. No.: 17/830,542

(22) Filed: Jun. 2, 2022

(65) Prior Publication Data

US 2023/0255383 A1 Aug. 17, 2023

Related U.S. Application Data

(63) Continuation-in-part of application No. 17/673,991, filed on Feb. 17, 2022, now abandoned.

(51) Int. Cl.
*A47G 27/02* (2006.01)
*A47B 91/12* (2006.01)

(52) U.S. Cl.
CPC ..... *A47G 27/0206* (2013.01); *A47B 91/12* (2013.01)

(58) Field of Classification Search
CPC .... A47G 27/0206; A47B 91/12; B60B 33/00; B60B 33/0002; B60B 33/001; B60B 33/0018; B60B 33/0005; B60B 33/0023
USPC ..... 248/346.01, 188.9
See application file for complete search history.

(56) References Cited

U.S. PATENT DOCUMENTS 1,374,029 A * 4/1921 Prickett ..... A47B 91/12 248/346.11
2,206,120 A * 7/1940 Peterson ..... A47B 91/026 248/188.4
2,865,133 A * 12/1958 Hoven ..... A47B 13/06 248/188.9
2,968,116 A * 1/1961 Arenson ..... A47B 91/12 108/118
3,326,508 A * 6/1967 Born ..... A47B 91/06 248/346.11
4,124,917 A * 11/1978 Gilliland ..... A47B 91/06 16/42 R
5,081,740 A * 1/1992 Smith ..... A47B 91/06 16/42 R
5,802,669 A * 9/1998 Wurdack ..... A47B 91/002 16/42 R
6,324,725 B1 * 12/2001 Green ..... A47C 7/002 16/42 T
6,405,982 B2 * 6/2002 Ferencz ..... A47B 91/06 248/346.11

(Continued)

*Primary Examiner* — Nkeisha Smith

(57) ABSTRACT

The present disclosure provides a novel design for an apparatus for protecting a floor, the apparatus comprising a plastic plate, a cushioning element, and a sliding element. Both the cushioning elements and sliding elements can be detachably coupled to opposing sides of the plastic plate via adhesive layers. The apparatus can thus take different forms for either sliding or resting furniture legs and casters over both carpeted floors and hard floors. The plastic plate is shaped with a raised lip so as to prevent contact with the floor even when the deformable sliding and cushioning elements are crushed by the heavy weight of furniture. The raised lip is formed so as to form a retaining wall about the concave receiving area where furniture legs may be placed when it is used as a caster. Also provided herein is a kit comprising multiple plastic plates, cushioning elements, and sliding elements, which a user can combine as they see fit for different functions.

18 Claims, 3 Drawing Sheets

(56) References Cited

U.S. PATENT DOCUMENTS 6,464,256 B1 * 10/2002 Edwards ..... A47B 91/06 280/845
6,754,934 B1 * 6/2004 Shiffler ..... A47B 91/06 16/42 T
6,840,488 B2 * 1/2005 Ngo ..... A47B 91/12 248/346.11
6,869,052 B2 * 3/2005 Keast ..... A47B 91/06 248/346.11
6,901,629 B2 * 6/2005 Wurdack ..... A47B 91/002 248/188.9
6,910,246 B2 * 6/2005 Desmarais ..... A47C 7/002 16/42 T
7,762,506 B2 * 7/2010 Beshore ..... A47C 7/002 411/510
8,015,663 B2 * 9/2011 Vorpahl ..... A47B 91/066 248/346.11
8,234,751 B2 * 8/2012 Bushey ..... A47B 91/06 16/42 R
8,321,994 B2 * 12/2012 Edwards ..... B62B 15/00 16/42 R
8,438,701 B2 * 5/2013 Bushey ..... A47B 91/06 16/42 T
9,027,891 B2 * 5/2015 Desmarais ..... B60B 33/0042 248/188.9
9,894,995 B2 * 2/2018 Downs ..... A47B 91/02
9,968,194 B2 * 5/2018 Bushey ..... A47B 91/06
2005/0081330 A1 * 4/2005 Edwards ..... A47B 91/06 16/42 R
2007/0234507 A1 * 10/2007 Vorpahl ..... A47B 91/066 16/42 R
2008/0258023 A1 * 10/2008 Desmarais ..... A47C 7/002 248/188.9
2010/0018005 A1 * 1/2010 Bushey ..... A47C 7/002 16/42 T
2012/0061545 A1 * 3/2012 Schneider ..... A47B 95/043 248/345.1

* cited by examiner

APPARATUS AND KIT FOR FLOOR PROTECTION

CROSS REFERENCES TO RELATED APPLICATIONS

The present application claims the benefit and priority of US non-provisional application no. U.S. Ser. No. 17/673,991, filed 17 Feb. 2022.

FIELD OF INVENTION

The present invention relates generally to apparatus for protecting floors from damage by furniture. More specifically, the present invention relates to a plastic plate with removable cushioning and sliding elements that can be configured differently for both sliding and resting furniture on carpets and hard floors.

BACKGROUND

Users often wish to move and rest furniture in different positions in their living spaces, which can easily lead to damage of the floors over which they are moved/rested by the furniture legs and casters (the wheels fitted underneath furniture) due to the high weights.

This problem has been partially solved by the development of caster cups, which are small cup shaped objects, often made of metal, with a concave receiving area for resting the furniture legs/casters on, and a soft cushioning element on the opposing side to prevent damage to the floor. A user manoeuvres the furniture into the position they want it and then rests each leg or caster of the furniture on a respective caster cup to prevent damage. This is also effective for preventing permanent indents forming on carpeted floors, since the cup distributes the weight of the furniture over a wider surface area.

However, this does not help with the process of actually moving the furniture, since the cushioning elements on the bottoms of the caster cups are crushed and compressed by the furniture resting on top to the point that the metal lips of the caster cups will often be in contact with the floor. The metal lips would thus damage the floor if they were slid across it. So, to move a piece of furniture a user must take out the caster cups and procure and use a set of furniture sliders, which are of similar construction to caster cups but with a soft, low friction coefficient bottom elements and lips that do not come into contact with the floor.

It would be beneficial for users to have access to a more versatile product which fulfilled both the functions of sliding and holding furniture legs and casters, and which could be adapted for use on both hard floors and carpeted floors. It is within this context that the present invention is provided.

SUMMARY

The present disclosure provides a novel design for an apparatus for protecting a floor, the apparatus comprising a plastic plate, a cushioning element, and a sliding element. Both the cushioning elements and sliding elements can be detachably coupled to opposing sides of the plastic plate via adhesive layers. The apparatus can thus take different forms for either sliding or resting furniture legs and casters over both carpeted floors and hard floors. The plastic plate is shaped with a raised lip so as to prevent contact with the floor even when the deformable sliding and cushioning elements are crushed by the heavy weight of furniture. The raised lip is formed so as to form a retaining wall about the concave receiving area where furniture legs may be placed when it is used as a caster. Also provided herein is a kit comprising multiple plastic plates, cushioning elements, and sliding elements, which a user can combine as they see fit for different functions.

Thus, according to one aspect of the present disclosure there is provided an apparatus for protecting a floor, the apparatus comprising: a plastic plate formed of a base portion having a flat first surface, a flat second surface opposite to the first surface, and a raised lip encompassing the second surface to form a concave receiving area therewith, the raised lip being positioned at an angle so as to leave an empty space about the base portion and to form a retaining wall surrounding the concave receiving area; a flat cushioning element formed of a soft deformable material and being dimensioned to fit within the receiving area of the plastic plate, the cushioning element having a layer of adhesive covering one side, the layer of adhesive being covered by a removable film; and a sliding element formed of a soft deformable material having a low friction co-efficient and being dimensioned to cover the first surface of the base portion, the sliding element having a layer of adhesive covering one side, the layer of adhesive being covered by a removable film.

In some embodiments, the raised lip takes on a hooked profile, and has at least a portion which is at an acute angle with respect to the second surface of the concave receiving area. The portion at the acute angle may have a curved profile, a squared profile, or a geometric profile.

In some embodiments, the cushioning element is made of a closed cell foam material. The closed cell foam material may be for example Ethylene-Vinyl Acetate, EVA.

In some embodiments, the sliding element is made of felt.

In some embodiments, the raised lips of the plastic plate are positioned at least 2 mm from the surface of the base portion.

In some embodiments, the plastic plate has rounded corners.

In some embodiments, the receiving area of the plastic plate forms a rounded square shape which is at least 6 cm is length and at least 6 cm in width.

In some embodiments, the base portion of the plastic plate has a rounded profile to facilitate sliding over uneven surfaces.

According to another aspect of the present disclosure, there is provided a kit for protecting a floor, the kit comprising: a plurality of plastic plates, each plate being formed of a base portion having a flat first surface, a flat second surface opposite to the first surface, and a raised lip encompassing the second surface to form a concave receiving area therewith, the raised lip being positioned at an angle so as to leave an empty space about the base portion; a plurality of flat cushioning elements, each cushioning element being formed of a soft deformable material and being dimensioned to fit within the receiving area of the plastic plate, the cushioning element having a layer of adhesive covering one side, the layer of adhesive being covered by a removable film; and a plurality of sliding elements, each sliding element being formed of a soft deformable material having a low friction co-efficient and being dimensioned to cover the first surface of the base portion, the sliding element having a layer of adhesive covering one side, the layer of adhesive being covered by a removable film.

In some embodiments, the kit includes equal numbers of plastic plates, cushioning elements, and sliding elements.

BRIEF DESCRIPTION OF THE DRAWINGS

Various embodiments of the invention are disclosed in the following detailed description and accompanying drawings.

Figure 1:
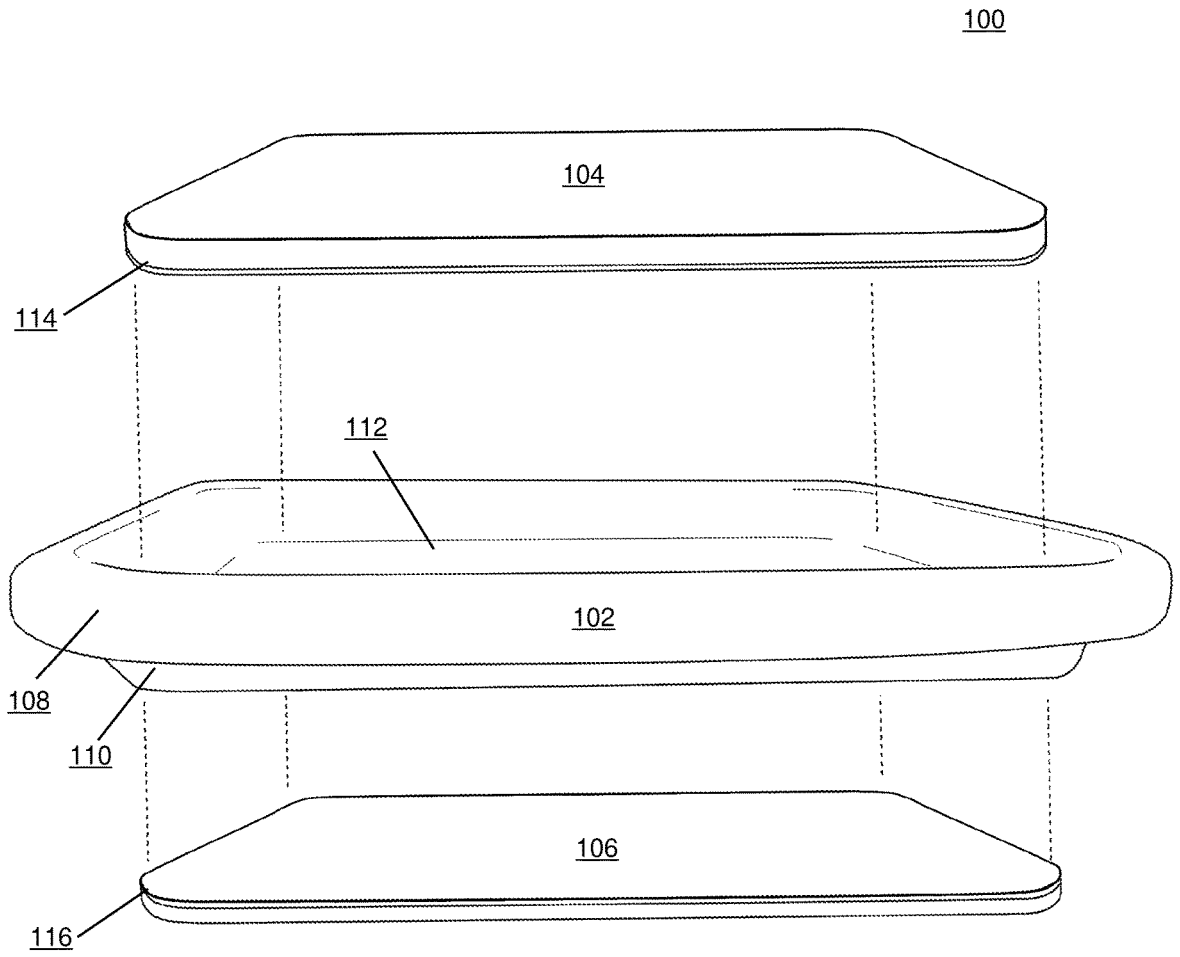
FIG. 1 illustrates a first isometric view of an example configuration of a disassembled apparatus according to the present disclosure, with the plastic plate, sliding element, and cushioning element separated from one another.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Referring to FIG. 1, a first isometric view of an example configuration of an apparatus 100 for protecting a floor is shown with the plastic plate 102, cushioning element 104, and sliding element 106 separated from one another.

The plastic plate 102 is formed of a base portion 110 having a flat first surface, a raised lip 108 that encompasses the base portion 110 but is positioned and angled away from it, and a second flat surface 112 which together with the raised lip 108 forms a receiving area. The receiving area of the plate may be in the shape of a rounded square approximately 6.5 cm in length and width to ensure many different types and sizes of caster and furniture leg can be comfortably placed on top. The raised lip 108 may for example be disposed 2 mm or more away from the bottom of the base portion 110 to ensure there is no risk of the lips touching and dragging along the floor even with heavy furniture resting atop it compressing the deformable cushioning and sliding elements.

The apparatus 100 further comprises a cushioning element 104 shaped and dimensioned to be placed within the receiving area of the plastic plate. The cushioning element 104 has a layer of adhesive formed on one side, the layer of adhesive being covered by a removable film 114.

Figure 2:
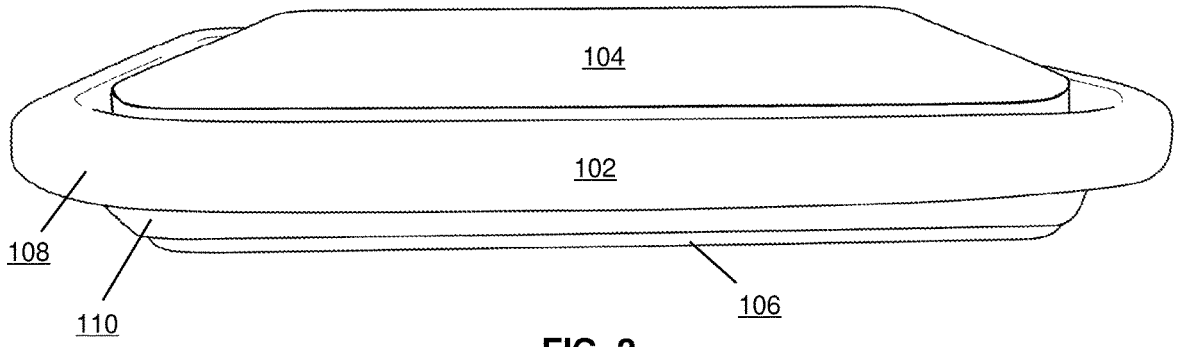
FIG. 2 illustrates an isometric view of a first use case configuration of the example apparatus for use in sliding furniture over a hard floor.
Figure 3:
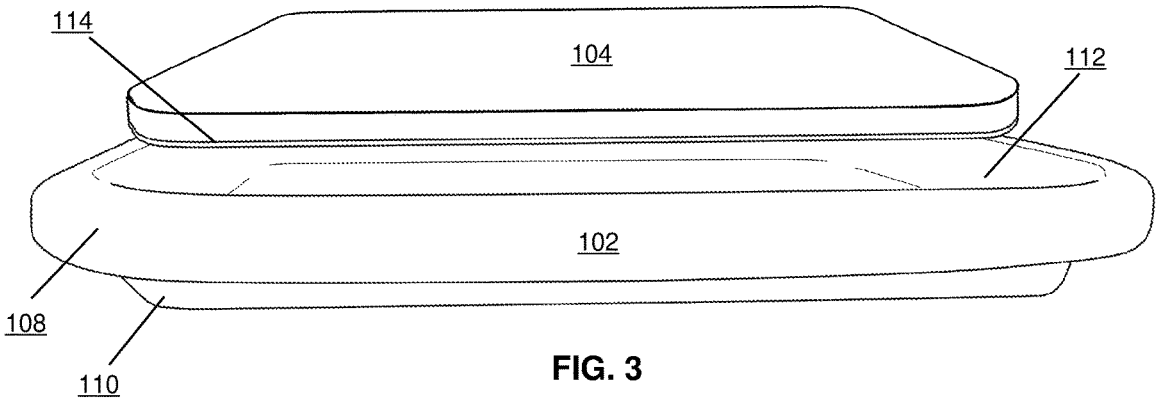
FIG. 3 illustrates an isometric view of a second use case configuration of the example apparatus for use in sliding furniture over a carpet.

In use, a furniture leg or caster will either be placed directly on the flat surface 112 of the receiving area, or the film 114 will be removed from the cushioning element 104 and the cushioning element will be placed within the receiving area as shown in FIG. 2 and FIG. 3, adhering and detachably coupling to the plastic plate via the layer of adhesive.

The cushioning element 104 is generally flat and formed of a soft deformable material such as a closed cell foam material. The closed cell foam material may be for example Ethylene-Vinyl Acetate, EVA. Ethylene-Vinyl Acetate is a versatile material often used in floor and exercise mats, sports equipment, crafts, kickboards, life jackets, flip-flops, and props and costumes.

The sliding element 106 is dimensioned to cover the entirety of the flat surface of the base portion 110 and, similarly to the cushioning element, has a layer of adhesive covering one side which is covered by a removable film 116, the layer of adhesive permitting a detachable coupling between the sliding element 106 and the base portion 110 once the film is removed. The sliding element 106 is made of a soft, deformable, and low friction co-efficient material such as for example felt. This enables furniture to be moved over hard floors more easily when the sliding element is placed under the base portion.

FIGS. 2-5 show four different configurations of the disclosed apparatus for four different use cases.

Referring to FIG. 2, an isometric view of a first use case configuration of the example apparatus 100 is shown, with both the cushioning element 104 and the sliding element 106 coupled to the plastic plate 102 for use in sliding furniture over a hard floor. As can be seen, the raised lip 108 is disposed away from the bottom surface of the base portion 110 and the sliding element 106 which will be in contact with the floor.

Referring to FIG. 3, an isometric view of a second use case configuration of the example apparatus 100 is shown with only the cushioning element 104 and the plastic plate 102 for use in sliding furniture over a carpet, since the sliding element 106 would simply create additional friction in this situation.

Figure 4:
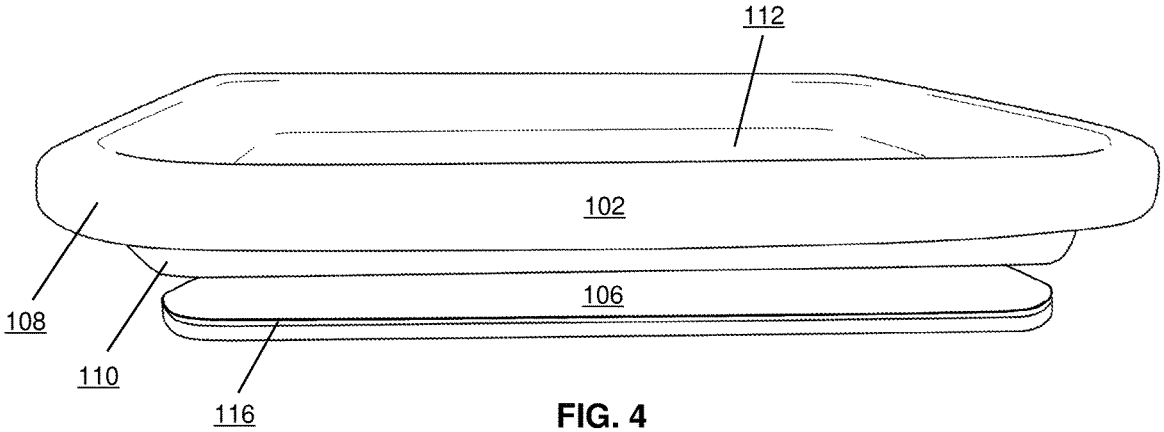
FIG. 4 illustrates an isometric view of a third use case configuration of the example apparatus for use as a caster cup in sliding furniture over a hard floor.

Referring to FIG. 4, an isometric view of a third use case configuration of the example apparatus 100 is shown with only the sliding element 106 and the plastic plate 102 for use as a caster cup in sliding furniture over a hard floor. No cushioning element is needed here since the furniture is not being moved and thus the legs and casters of the furniture do not need to be held in position on the top of the plate 102.

Figure 5:
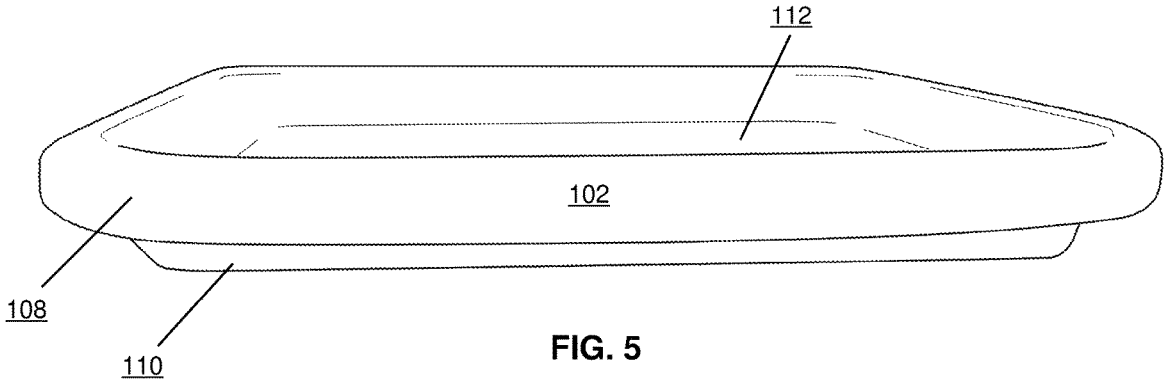
FIG. 5 illustrates an isometric view of a fifth use case configuration of the example apparatus for use as a caster cup over a carpet.

Referring to FIG. 5, an isometric view of a fifth use case configuration of the example apparatus 100 is shown with only the plastic plate 102 needed for use as a caster cup over a carpet, since the carpet itself is not at risk of being scratched, only the plastic plate 102 is needed to distribute the weight of the furniture legs/casters more across a wider surface area.

When used as a caster, the disclosed apparatus should be designed so as to prevent furniture legs from sliding out of the concave receiving area under transverse force or movement. In some cases, the disclosed shape of the raised lip 108 of the plastic plate as shown in FIGS. 1 through 5 may be insufficient.

Thus, some alternative profiles of the raised lip of the plastic plate are also provided herein, with the raised lip taking on different profiles which form more suitable acute angles with the floor of the concave receiving area, which in turn forms a retaining wall that surrounds the concave receiving area and prevents furniture legs etc form sliding out and over the raised lip under transverse forces.

Figure 6A:
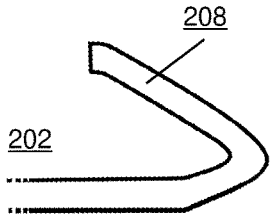
FIG. 6A illustrates a cross-sectional view of a first example alternative raised lip configuration for improving the performance of the apparatus when used as a caster cup.
Figure 6B:
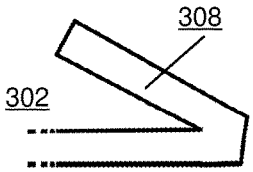
FIG. 6B illustrates a cross-sectional view of a second example alternative raised lip configuration for improving the performance of the apparatus when used as a caster cup.
Figure 6C:
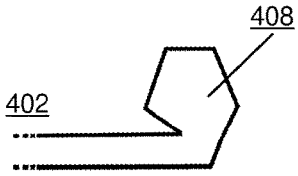
FIG. 6C illustrates a cross-sectional view of a third example alternative raised lip configuration for improving the performance of the apparatus when used as a caster cup.

Referring to FIG. 6A, FIG. 6B, and FIG. 6C, cross sectional views are shown of some example profiles the raised lip could take which would improve the retaining capability of the apparatus when used as a caster cup. These are merely example profiles, and are not meant as an exhaustive list.

FIG. 6A illustrates a cross-sectional view of a plastic plate 202 which has a hooked raised lip 208 with a curved profile.

FIG. 6B illustrates a cross-sectional view of a plastic plate 302 which has a hooked raised lip 308 with a squared profile.

FIG. 6C illustrates a cross-sectional view of a plastic plate 402 which has a raised lip 408 with a geometric hexagonal profile.

Figure 7A:
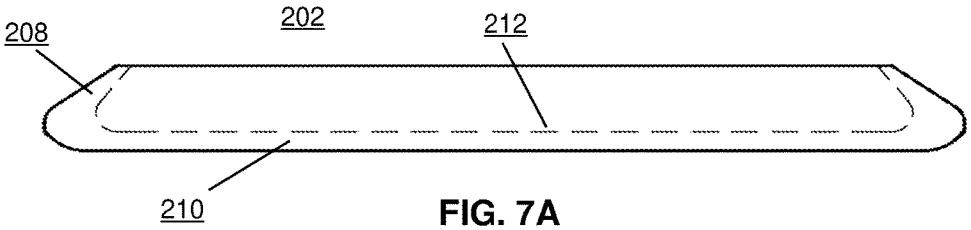
FIG. 7A illustrates a cross-sectional view of an alternative example configuration of a plastic plate having a raised lip profile as shown in FIG. 6A.
Figure 7B:
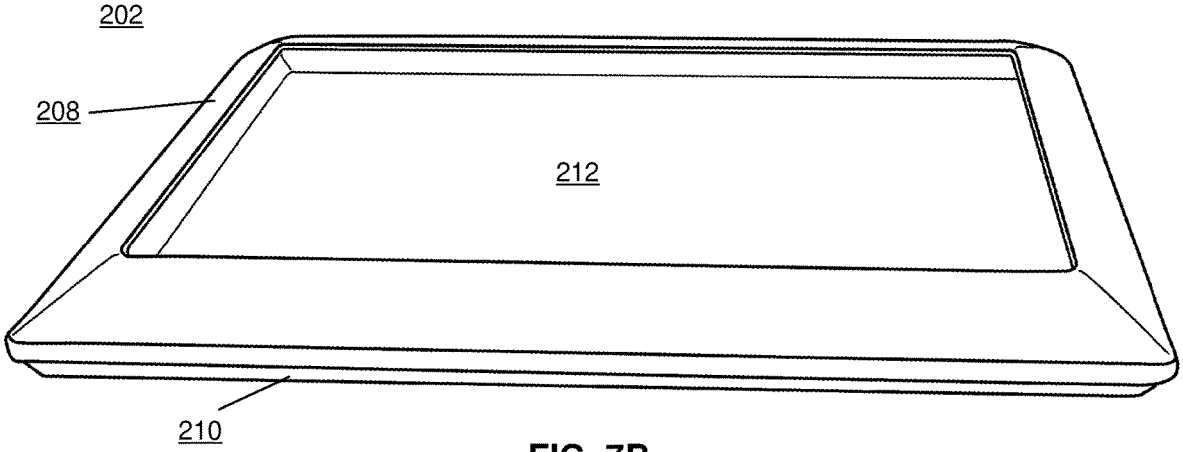
FIG. 7B illustrates a perspective view of the alternative example configuration of the plastic plate.
Figure 7C:
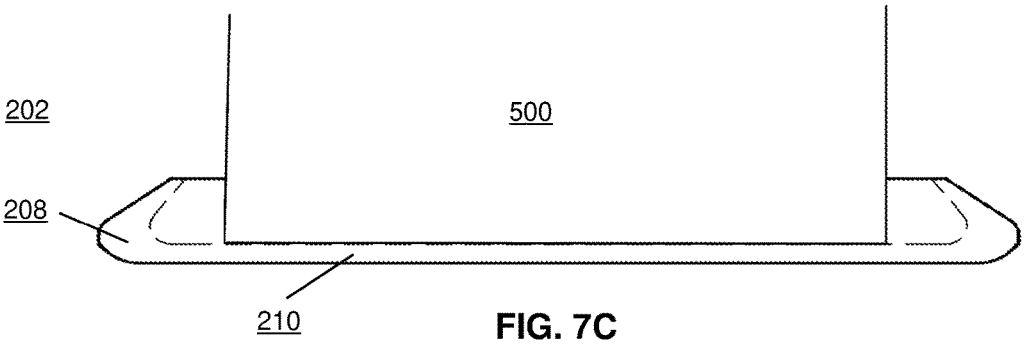
FIG. 7C illustrates a cross-sectional view of a bottom of a furniture leg being held within the concave receiving area of the alternative configuration of the plastic plate.

FIG. 7A, FIG. 7B, and FIG. 7C show full views of a plastic plate 208 with a raised lip profile as shown in FIG. 6A. FIG. 7A shows a cross-sectional view of the alternative configuration. As can be seen, it still has a base 210 that forms the bottom of the concave receiving area. This can also be seen in the perspective view of FIG. 7B.

FIG. 7C shows the bottom of a furniture leg 500 being held within the plastic plate 208 during use as a caster cup. As can be seen, the hooked shape of the raised lip 208 will make it much more difficult for the furniture leg 500 to slide out of the plastic plate 208 due to the hooked profile and the acute angle between the upper portion of the raised lip and the bottom of the concave receiving area 212.

As demonstrated above, only some elements of the apparatus are needed for performing certain functions, and the elements are detachable from one another. Furthermore, each piece of furniture is likely to require multiple legs/casters to be fitted. Thus, a kit comprising multiple plastic plates, cushioning elements, and sliding elements is provided herein. For example, 12 of each type of element may be provided in such a kit.

It should be noted that the apparatus of the present disclosure is completely reusable, and the sliding and cushioning elements can be attached and detached form the plastic plate multiple times if the right type of adhesive is used.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the kit and apparatus for protecting a floor have been described in a specific manner referring to the illustrated embodiments, it is understood that the present invention can be applied to a wide variety of solutions which fit within the scope and spirit of the claims. There are many alternative ways of implementing the invention.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. Apparatus for protecting a floor, the apparatus comprising:

a plastic plate formed of a base portion having a flat first surface, a flat second surface opposite to the first surface, and a raised lip encompassing the second surface to form a concave receiving area therewith, the raised lip being positioned at an angle so as to leave an empty space about the base portion and to form a retaining wall surrounding the concave receiving area;

a flat cushioning element formed of a soft deformable material and being dimensioned to fit within the receiving area of the plastic plate, the cushioning element having a layer of adhesive covering one side for detachably coupling to the second surface of the base portion, the layer of adhesive being covered by a removable film; and a sliding element formed of a soft deformable material having a low friction co-efficient and being dimensioned to cover the first surface of the base portion, the sliding element having a layer of adhesive covering one side for detachably coupling to the first surface of the base portion, the layer of adhesive being covered by a removable film.

2. Apparatus for protecting a floor according to claim 1, wherein the raised lip takes on a hooked profile, and has at least a portion which is at an acute angle with respect to the second surface of the concave receiving area.

3. Apparatus for protecting a floor according to claim 2, wherein the portion at the acute angle has a curved profile, a squared profile, or a geometric profile.

4. Apparatus for protecting a floor according to claim 1, wherein the cushioning element is made of a closed cell foam material.

5. Apparatus for protecting a floor according to claim 4, wherein the closed cell foam material is Ethylene-Vinyl Acetate, EVA.

6. Apparatus for protecting a floor according to claim 1, wherein the sliding element is made of felt.

7. Apparatus for protecting a floor according to claim 1, wherein the raised lips of the plastic plate are positioned at least 2 mm from the surface of the base portion.

8. Apparatus for protecting a floor according to claim 1, wherein the plastic plate has rounded corners.

9. Apparatus for protecting a floor according to claim 1, wherein the receiving area of the plastic plate forms a rounded square shape which is at least 6 cm is length and at least 6 cm in width.

10. Apparatus for protecting a floor according to claim 1, wherein the base portion of the plastic plate has a rounded profile to facilitate sliding over uneven surfaces.

11. A kit for protecting a floor containing apparatus according to claim 1, the kit comprising:

a plurality of plastic plates, each plate being formed of a base portion having a flat first surface, a flat second surface opposite to the first surface, and a raised lip encompassing the second surface to form a concave receiving area therewith, the raised lip being positioned at an angle so as to leave an empty space about the base portion;

a plurality of flat cushioning elements, each cushioning element being formed of a soft deformable material and being dimensioned to fit within the receiving area of the plastic plate, the cushioning element having a layer of adhesive covering one side for detachably coupling to the second surface of the base portion, the layer of adhesive being covered by a removable film; and a plurality of sliding elements, each sliding element being formed of a soft deformable material having a low friction co-efficient and being dimensioned to cover the first surface of the base portion, the sliding element having a layer of adhesive covering one side for detachably coupling to the first surface of the base portion, the layer of adhesive being covered by a removable film.

12. A kit for protecting a floor according to claim 11, wherein each cushioning element is made of a closed cell foam material.

13. A kit for protecting a floor according to claim 12, wherein the closed cell foam material is Ethylene-Vinyl Acetate, EVA.

14. A kit for protecting a floor according to claim 11, wherein each sliding element is made of felt.

15. A kit for protecting a floor according to claim 11, wherein the raised lips of each plastic plate are positioned at least 2 mm from the surface of the base portion.

16. A kit for protecting a floor according to claim 11, wherein each plastic plate has rounded corners.

17. A kit for protecting a floor according to claim 11, wherein the receiving area of each plastic plate forms a rounded square shape which is at least 6 cm is length and at least 6 cm in width.

18. A kit for protecting a floor according to claim 11, wherein the kit includes equal numbers of plastic plates, cushioning elements, and sliding elements.

* * * * *